US012667130B2

(12) United States Patent
Cantieri

(10) Patent No.: US 12,667,130 B2
(45) Date of Patent: Jun. 30, 2026

(54) APPLYING AN ADDITIVE FROM RADIALLY OUTSIDE UPON PRODUCTION OF AN AEROSOL-GENERATING ROD

(71) Applicant: PHILIP MORRIS PRODUCTS S.A., Neuchatel (CH)

(72) Inventor: Fabio Cantieri, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 480 days.

(21) Appl. No.: 18/029,405

(22) PCT Filed: Oct. 8, 2021

(86) PCT No.: PCT/EP2021/077855
§ 371 (c)(1),
(2) Date: Mar. 30, 2023

(87) PCT Pub. No.: WO2022/074190
PCT Pub. Date: Apr. 14, 2022

(65) Prior Publication Data

US 2023/0354881 A1 Nov. 9, 2023

(30) Foreign Application Priority Data

Oct. 9, 2020 (EP) ..... 20201038

(51) Int. Cl.
*A24C 5/01* (2020.01)
*A24C 5/18* (2006.01)
*A24D 1/20* (2020.01)

(52) U.S. Cl.
CPC ..... *A24C 5/01* (2020.01); *A24C 5/1807* (2013.01); *A24C 5/1892* (2013.01); *A24D 1/20* (2020.01)

(58) Field of Classification Search
CPC ..... A24C 5/01; A24C 5/1807; A24C 5/1892; A24D 1/20
See application file for complete search history.

(56) References Cited

U.S. PATENT DOCUMENTS 4,979,521 A 12/1990 Davis
11,058,141 B2 7/2021 Sanna
(Continued)

FOREIGN PATENT DOCUMENTS

CN 109924541 6/2019
CN 110545680 12/2019
(Continued)

OTHER PUBLICATIONS

DE 102017109897 A1_Espacenet_Machine_English_Translation (Year: 2025).*
(Continued)

*Primary Examiner* — Michael H. Wilson
*Assistant Examiner* — Ronnie Kirby Jordan
(74) *Attorney, Agent, or Firm* — Mueting Raasch Group

(57) ABSTRACT

A device (1) for producing an aerosol-generating rod (3) comprises a converging device (5), a susceptor guide (19), and a conveyor system. The converging device has a forming space converging along an axial direction (17). The susceptor guide extends into the forming space of the converging device and comprises an exit opening (21) for a susceptor (23) within the forming space (9) of the converging device. The conveyor system is configured to convey filling material (15), preferably formed as a sheet, through the forming space of the converging device to shape the filling material into a rod incorporating the susceptor. The device further comprises at least one additive supply line
(Continued)

(29) having a dispensing opening that opens into the forming space of the converging device radially outward of the susceptor guide.

6 Claims, 2 Drawing Sheets

(56) References Cited

U.S. PATENT DOCUMENTS

| | | | | |
|---|---|---|---|---|
| 2010/0224202 | A1 | 9/2010 | Mclellan | |
| 2018/0027883 | A1 | 2/2018 | Zuber | |
| 2018/0279677 | A1 | 10/2018 | Blandino | |
| 2018/0295885 | A1 | 10/2018 | Batista | |
| 2020/0029623 | A1 | 1/2020 | Rossoll | |
| 2020/0107571 | A1 | 4/2020 | Sanna | |
| 2022/0132907 | A1* | 5/2022 | Batista et al. | A24C 5/01 |

FOREIGN PATENT DOCUMENTS

| | | |
|---|---|---|
| CN | 111672430 | 9/2020 |
| DE | 102017109897 | 11/2018 |
| EP | 3367823 | 9/2018 |
| WO | WO 2018002084 | 1/2018 |
| WO | WO 2020174026 | 9/2020 |

OTHER PUBLICATIONS

CN 109924541 A1_Espacenet_Machine_English_Translation (Year: 2025).*

PCT International Search Report and Written Opinion for PCT/EP2021/077855 dated Mar. 23, 2022 (17 pages).

International Preliminary Report on Patentability for PCT/EP2021/077855 dated Dec. 13, 2022 (34 pages).

Office Action issued in China for Application No. 202180065054.5 dated Apr. 24, 2025 (31 pages). English translation included.

* cited by examiner

APPLYING AN ADDITIVE FROM RADIALLY OUTSIDE UPON PRODUCTION OF AN AEROSOL-GENERATING ROD

This application is a U.S. National Stage Application of International Application No. PCT/EP2021/077855 filed Oct. 8, 2021, which was published in English on Apr. 14, 2022, as International Publication No. WO 2022/074190 A2. International Application No. PCT/EP2021/077855 claims priority to European Application No. 20201038.5 filed Oct. 9, 2020.

The present disclosure relates to aerosol-generating rods, in particular for use in the production aerosol-generating articles, in particular for consumer products.

In particular, the present disclosure relates to applying an additive to a filling material that is formed into a rod incorporating a heatable susceptor.

It is known from practice to reshape sheet material with a shaping device to obtain a rod for use in the production of aerosol-generating articles. The rod may incorporate a susceptor therein to allow generating heat by subjecting the susceptor to an alternating magnetic field. This allows heating the rod from within to cause the release aerosol from the rod.

It may be desirable to allow adding one or more substances upon production of an aerosol-generating rod. For example, it may be desirable to add aerosol-generating substances or flavorful substances to the rod. It may be desirable to provide an efficient way of modifying the properties of the rod by adding one or more substances. It may be desirable to provide a way of obtaining a favorable distribution of one or more substance within the rod.

According to an aspect of the present invention, there is provided a device for producing an aerosol-generating rod. The device comprises a converging device, a susceptor guide, a conveyor system and at least one additive supply line. The converging device has a forming space converging along an axial direction. The susceptor guide extends into the forming space of the converging device. The susceptor guide comprises an exit opening for a susceptor within the forming space of the converging device. The conveyor system is configured to convey filling material through the forming space of the converging device to shape the filling material into a rod incorporating the susceptor. The at least one additive supply line has a dispensing opening that opens into the forming space of the converging device radially outward of the susceptor guide.

The at least one additive supply line with its dispensing opening that opens into the forming space of the converging device allows dispensing additive within the forming space of the converging device. Dispensing the additive within the forming space of the converging device may ensure that a high percentage, in particular at least 95 percent, of the dispensed additive or all of the dispensed additive is actually incorporated into the rod, thereby reducing waste of additive and contamination of equipment by the additive. As the additive may be dispensed onto the filling material while the filling material is shaped within the converging device, distribution of the additive over the filling material may be facilitated.

The distribution of the additive within the final rod may be influenced by appropriately selecting the exact location of the dispensing opening within the forming space of the converging device, for example.

Dispensing the additive through the dispensing opening into the forming space of the converging device radially outward of the susceptor guide may facilitate obtaining a favorable distribution of the additive in the rod. In particular, homogenous distribution of the additive over the filling material may be facilitated. As the dispensing opening opens into the forming space of the converging device radially outward of the susceptor guide, the amount of additive that is directly dispensed onto the susceptor, and not on the filling material, may be reduced. Dispensing the additive through the dispensing opening radially outward of the susceptor guide may facilitate contact between the additive and the filling material, when the filling material is shaped into a rod incorporating the susceptor. Thus, the filling material may efficiently work as carrier for the additive. Direct contact between the additive and the susceptor may, in certain practical applications, be undesirable. For example, additive that is in direct contact with the susceptor may cause difficulties with regulating a heating function of the susceptor.

The converging device may comprise one or more walls that are engaged by the filling material upon conveying the filling material through the converging device. Contact between the one or more walls of the converging device and the filling material may shape the filling material into the rod, for example by one or more of bending, folding and compressing the sheet material.

The forming space of the converging device may at least partially be defined or delimited by the one or more walls of the converging device.

The converging device may be configured to increasingly compress the filling material as the filling material progresses through the forming space of the converging device along the axial direction. The converging device may be configured to increasingly compress the filling material around the susceptor as the filling material progresses through the converging device along the axial direction.

The converging device may be a funnel-shaped converging device.

The converging device may extend along the axial direction from a first end of the converging device to a second end of the converging device. An area of the cross section of the forming space of the converging device, in a sectional plane perpendicular to the axial direction, may decrease from the first end of the converging device to the second end of the converging device, in particular continuously or in a stepwise manner. There may be one or more sections along the axial direction along which the area of a cross section of the forming space, in a sectional plane that is perpendicular to the axial direction, remains constant or locally increases along the axial direction.

A diameter of the forming space of the converging device may be greater at the first end of the converging device than at the second end of the converging device. A diameter of the forming space of the converging device at the second end of the converging device, where the rod exits the converging device, may be between 0.3 centimeters and 2 centimeters, or between 0.3 centimeters and 1.5 centimeters, or between 0.5 centimeters and 1 centimeter, for example.

The susceptor guide or one or more sections of the susceptor guide may extend within the forming space of the converging device along the axial direction. An end section of the susceptor guide comprising the exit opening may extend within the forming space of the converging device along the axial direction. The susceptor guide may extend into the forming space of the converging device along the axial direction.

The exit opening of the susceptor guide may open into the axial direction, so that the susceptor leaves the susceptor guide along the axial direction.

The conveyor system may be configured to convey the filling material through the forming space of the converging device along a direction that at least has a component in the axial direction. The conveyor system may be configured to convey the filling material through the forming space of the converging device at least essentially along the axial direction, or at least essentially in parallel to the axial direction.

The conveyor system may be configured to convey the filling material through the forming space of the converging device from the first end of the converging device to the second end of the converging device.

The conveyor system may be configured to convey filling material that is formed as one or more sheets through the forming space of the converging device to shape the filling material into the rod incorporating the susceptor.

The conveyor system may be configured to convey the susceptor. The conveyor system may be configured to convey the susceptor through the susceptor guide. The conveyor system may be configured to convey the susceptor from the exit opening of the susceptor guide to the second end of the converging device. The conveyor system may be configured to convey the susceptor at least essentially along the axial direction, or at least essentially in parallel to the axial direction.

The at least one additive supply line may protrude into the forming space of the converging device by no more than 20 millimeters, or no more than 10 millimeters, or no more than 5 millimeters, or no more than 3 millimeters, or no more than 2 millimeters, or no more than 1 millimeter. Limiting the protrusion of the additive supply line into the forming space may reduce the risk of damaging the filling material due to contact with the additive supply line. Further, limiting the protrusion of the additive supply line into the forming space may ensure that additive is supplied to radially outer regions of the rod.

The at least one additive supply line may be inclined at the dispensing opening into the axial direction, as compared to a direction perpendicular to the axial direction. Towards the dispensing opening, the additive supply line may extend in a direction that has a component along the axial direction. The at least one additive supply line being inclined at the dispensing opening into the axial direction may facilitate the additive being received by the filling material and taken along by the filling material.

The at least one additive supply line may comprise exactly one additive supply line. The at least one additive supply line may comprise more than one additive supply line. The at least one additive supply line may comprise two additive supply lines, three additive supply lines, four additive supply lines, or more than four additive supply lines. The at least one additive supply line may comprise a plurality of additive supply lines. Providing more than one additive supply line may enable dispensing additive at different locations within the forming space of the converging device. Providing more than one additive supply line may enable supplying different additives through different additive supply lines.

The dispensing openings of at least two of the additive supply lines may be arranged at different circumferential positions around the axial direction. Additive supplied through said at least two of the additive supply lines may be dispensed from different angles around the circumference of the converging device. Dispensing additive through said at least two of the additive supply lines may facilitate distributing additives over the filling material. Additive dispensed through the dispensing openings of said at least two of the additive supply lines may be dispensed from different sides of the susceptor guide, or from different sides of the susceptor.

The dispensing openings of the additive supply lines may be arranged symmetrically with respect to the axial direction as axis of symmetry. A symmetric arrangement of the dispensing openings may facilitate a homogenous distribution of additive.

A first dispensing opening of a first additive supply line and a second dispensing opening of a second additive supply line may be located on opposing sides with respect to the susceptor guide. Dispensing additive from opposing sides of the susceptor guide may facilitate distribution of additive over portions of the filling material that are located on opposing sides of the susceptor guide.

A dispensing opening of an additive supply line may be upstream of a dispensing opening of another additive supply line with respect to the axial direction. Having dispensing openings of additive supply lines at different positions along the axial direction may allow dispensing additive onto the filling material at different stages of shaping the filling material.

The device may further comprise a converging device heating assembly configured to actively heat a heating region of the forming space. Actively heating the heating region of the forming space may reduce the viscosity of the additive in the heating region of the forming space, thus facilitating distribution of the additive over the filling material. The heating region may be at least partially downstream of the dispensing opening of the at least one additive supply line with respect to the axial direction. In the heating region, additive that has already been dispensed into the forming space through the dispensing opening may be heated to reduce the viscosity of the additive, or to prevent the viscosity of the additive from increasing, or to reduce a rate at which the viscosity of the additive increases. The heating region may at least partially lie in a region in which the forming space converges along the axial direction.

The device may further comprise an additive supply line heating assembly configured to actively heat the at least one additive supply line. Heating the at least one additive supply line may heat the additive within the additive supply line and may decrease viscosity of the additive, thereby facilitating supplying the additive through the additive supply line.

The device may further comprise a cooling assembly configured to actively cool the rod. The cooling assembly may be configured to actively cool the rod downstream of the at least one dispensing opening. The cooling assembly may be configured to cool the rod at a position along the axial direction at which shaping the filling material into the rod incorporating the susceptor is completed. The cooling assembly may cool the rod by cooling a cooling region. The cooling region may be part of the forming space of the converging device. The cooling region may at least partly be inside the forming space of the converging device. The cooling region may at least partly be downstream of the second end of the converging device. The cooling assembly may be configured to cool the rod at or downstream of the second end of the converging device. Cooling the rod may reduce the viscosity of the additive within the rod after formation of the rod is completed, for example. Cooling the rod may, at least to a certain extent, fix the additive at its position within the rod by reducing the viscosity of the additive within the rod.

The device may further comprise a first additive reservoir and a second additive reservoir. The first additive reservoir may be connected to a first additive supply line. The second additive reservoir may be connected to a second additive supply line. The first and the second additive supply lines may be any one of the additive supply lines described herein. Providing separate additive reservoirs for different additive supply lines may enable supplying different kinds of additives separately.

Preferably, the additive is a thixotropic gel.

One or more rotating blades may be provided in the additive reservoirs. Rotation of the blades may reduce the viscosity of the additive in the reservoirs.

The additive reservoirs may be heated to reduce the viscosity of the additive in the reservoirs.

The device may further include a vibration device configured to actively induce vibrations of at least a part of the device, or of the device in total. In particular, the vibration device may be configured to induce vibrations of at least one of the converging device, the susceptor guide, and the additive supply line. Inducing vibrations by the vibration device may contribute to a better distribution of the additive in or into the rod. A frequency of the vibrations may be in a range of 20 kilohertz to 400 kilohertz, for example.

According to another aspect of the present invention, there is provided a method for producing an aerosol-generating rod. A susceptor band is conveyed through a forming space of a converging device along an axial direction. A filling material is shaped into a rod incorporating the susceptor band by conveying the filling material through the forming space of the converging device along the axial direction. An additive is dispensed onto the filling material through a first dispensing opening that opens into the forming space of the converging device. At least a part of the filling material passes between the first dispensing opening and the susceptor band while being conveyed through the forming space of the converging device.

As at least a part of the filling material passes between the first dispensing opening and the susceptor band in the forming space of the converging device, there may be the following arrangement from inside to outside along the radial direction within the forming space: susceptor band—filling material—first dispensing opening. Due to at least a part of the filling material passing between the dispensing opening and the susceptor band, dispensing the additive onto the filling material is facilitated. In particular, the additive may be dispensed onto the filling material, instead of being dispensed onto the susceptor band. Direct dispensing of the additive onto the filling material may be facilitated, thus making it possible for the filling material to efficiently act as carrier for the additive.

The susceptor band may be heatable by exposing the susceptor band to an electromagnetic field. The susceptor band may be heatable by electromagnetic induction. The susceptor band may, for example, be made of or comprise conductive material, such as metal or carbon.

The additive may be a gel or may comprise a gel. The provision of a gel may be advantageous for storage and transport, or during use, as the risk of leakage from the filling material or the aerosol-generating rod may be reduced.

Advantageously, the gel is solid at room temperature. 'Solid' in this context means that the gel has a stable size and shape and does not flow. Room temperature in this context means 25 degrees Celsius.

Advantageously, the gel, for example, comprises a thermoreversible gel. This means that the gel will become fluid when heated to a melting temperature and will set into a gel again at a gelation temperature. The gelation temperature may be at or above room temperature and atmospheric pressure. Atmospheric pressure means a pressure of 1 atmosphere. The melting temperature may be higher than the gelation temperature. The melting temperature of the gel may be above 50 degrees Celsius, or above 60 degrees Celsius, or above 70 degrees Celsius, or above 80 degrees Celsius. The melting temperature in this context means the temperature at which the gel is no longer solid and begins to flow.

Alternatively, in specific embodiments, the gel is a non-melting gel that does not melt during use of the susceptor.

Preferably, the gel has a viscosity of 50,000 to 10 Pascal per second, preferably 10,000 to 1,000 Pascal per second.

The gel may comprise a gelling agent. The gel may comprise agar or agarose or sodium alginate or Gellan gum, or a mixture thereof.

The gel may comprise water. For example, the gel may be a hydrogel. Alternatively, the gel may be non-aqueous.

The additive may be dispensed through the first dispensing opening at a position along the axial direction at which the filling material undergoes compression towards the susceptor band. Movement of the filling material due to compression towards the susceptor band may improve distribution of the additive over the filling material.

The method may comprise actively heating a heating region of the forming space. The heating region of the forming space may be at least partially downstream of the first dispensing opening with respect to axial direction. Actively heating the heating region may comprise heating additive in the heating region. Heating the additive in the heating region may lead to a reduction in the viscosity of the additive, as compared to a situation without the heating in the heating region. Reduction of viscosity of the additive may cause the additive to flow on the filling material, thereby increasing distribution of the additive over the filling material.

The method may comprise actively heating a first additive supply line supplying the additive to the first dispensing opening. Heating the first additive supply line may comprise heating additive within the first additive supply line. Heating the first additive supply line may cause a reduction in viscosity of the additive within the first additive supply line.

The method may comprise actively cooling the rod. Preferably, the rod is cooled at a position along the axial direction at which shaping the rod is complete. The rod may be cooled by actively cooling a cooling region. The cooling region may be part of the forming space of the converging device. The cooling region may at least partly be inside the forming space of the converging device. The cooling region may at least partly be downstream of the second end of the converging device. Actively cooling the rod may increase the viscosity of additive within the rod. Actively cooling the rod may stop the additive from flowing within the rod. Actively cooling the rod may fix the additive in position within the rod.

The filling material may be in the form of a sheet. The filling material may be sheet material. The filling material may comprise one or more sheets The sheet may have a thickness of less than 1 millimeter, or of less than 0.5 millimeters, or of less than 0.2 millimeters, or of less than 0.1 millimeters, or of less than 0.05 millimeters. The sheet may have a thickness of at least 0.001 millimeters, or of at least 0.01 millimeters, or of at least 0.1 millimeters. Sheet material having a comparatively low thickness may be easier to shape into the rod. Sheet material having a comparatively high thickness may be less likely to be torn or damaged upon dispensing the liquid onto the sheet material.

The sheet may be a crimped sheet. The method may comprise crimping the sheet upstream of the converging device. Crimping the sheet may facilitate shaping the sheet into the rod. If the sheet is crimped, the sheet may be more likely to form folds upon shaping the sheet. Folds in sheet may serve to receive additive.

Conveying the filling material through the forming space of the converging device may comprise simultaneously conveying two or more webs of filling material through the forming space. The two webs of filling material may enter the forming space on opposite sides of the susceptor band. Using two or more webs of filling material may facilitate shaping the filling material into a rod that incorporates the susceptor band.

A cross-section of the susceptor band in a sectional plane perpendicular to the axial direction may be rectangular, for example. The susceptor may be continuously conveyed through the susceptor guide. The susceptor may be continuously withdrawn from a supply roll.

The additive may be dispensed at a position within the converging device, at which a maximum diameter of the rod is at most 400 percent, or at most 350 percent, or at most 300 percent, or at most 250 percent, or at most 200 percent, or at most 150 percent of a maximum diameter of the final rod upon exiting the converging device. If the additive is dispensed at a position within the converging device, where the filling material has already been shaped or compressed to a certain degree, efficient distribution of the additive over the filling material may be facilitated.

The rod may be formed essentially coaxially around the susceptor band.

The additive may be dispensed upstream of the exit opening with respect to the axial direction.

The additive may be dispensed essentially at the position of the exit opening with respect to the axial direction.

The additive may be dispensed downstream of the exit opening with respect to the axial direction.

The method may comprise dispensing an additive through a second dispensing opening that opens into the forming space of the converging device. Dispensing additive through more than one dispensing opening allows dispensing a greater amount of additive. Dispensing additive through more than one dispensing opening may allow dispensing additive at different locations. Dispensing additive through more than one dispensing opening may facilitate different kinds of additives.

The first dispensing opening may be located upstream of the second dispensing opening with respect to the axial direction. Additive may be dispensed through the first dispensing opening and through the second dispensing opening at different stages of compression of the filling material. Additive dispensed through the second dispensing opening (downstream of the first dispensing opening) may tend to have a maximum in concentration at a radial position outward of the maximum in concentration of additive dispensed through the first dispensing opening in the final rod.

Additive may be dispensed through the first dispensing opening on a first side of the susceptor band. Additive may be dispensed through the second dispensing opening on a second side of the susceptor band. The first side of the susceptor band may be opposite to the second side of the susceptor band with respect to the axial direction.

The additive dispensed through the first dispensing opening may have a different composition than the additive dispensed through the second dispensing opening.

Additive may be dispensed through the first dispensing opening with a first pressure. Additive may be dispensed through the second dispensing opening with a second pressure. The first pressure may be different from the second pressure. The first pressure may be greater than the second pressure. The first pressure may be smaller than the second pressure. Dispensing additives with different pressures may lead to different penetration depths of the additives into the rod.

The additive may comprise one or more aerosol-generating substances. Suitable aerosol-generating substances may include, but are not limited to: polyhydric alcohols, such as triethylene glycol, 1, 3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The additive may comprise one or more of nicotine, a flavorant, glycerin, and propylene glycol.

The filling material may comprise one or more of herbaceous material, a fiber substrate, a cellulose substrate, a cotton substrate, and a foam. The filling material may be configured to generate aerosol upon heating by the susceptor band. Aerosol-generating substances of the additive may supplement aerosol-generating substances of the filling material.

Alternatively, neutral filling material may be used and aerosol-generating properties may be obtained by addition of the additive.

The filling material may soak up the additive.

According to another aspect of the present invention, there is provided an aerosol-generating rod. The aerosol-generating rod comprises a susceptor, a sleeve of filling material, and an aerosol-generating gel. The susceptor is heatable by exposing the susceptor to an alternating magnetic field. The sleeve of filling material surrounds the susceptor to form a rod incorporating the susceptor. The aerosol-generating gel is provided within the sleeve of filling material, without direct contact between the aerosol-generating gel and the susceptor.

Heating the susceptor may lead to release of aerosol by heating the aerosol-generating gel. As the rod comprises aerosol-generating gel, it is not required (but still possible) that filling material itself contains aerosol-generating substances. If the filling material itself comprises aerosol-generating substances, aerosol generated by the aerosol-generating gel upon heating of the susceptor may supplement aerosol generated by the filling material. Alternatively, a neutral filling material may be used and any desired aerosol generation may be by the aerosol-generating gel.

The lack of direct contact between the aerosol-generating gel and the susceptor may facilitate heating the susceptor in a controlled manner. Further, without direct contact between the aerosol-generating gel and the susceptor, aerosol generation by heating the gel via heating the susceptor may be easier to control.

The filling material may be sheet material or may be formed from sheet material.

The filling material may be crimped sheet material. If the filling material is crimped, the filling material may more easily form folds or other structures that are suitable to receive and hold the aerosol-generating gel.

The filling material may be a substrate of reconstituted herbaceous material, a fiber substrate, a cellulose substrate, a cotton substrate, or a foam substrate.

The susceptor may be provided at least essentially centrally within the rod. The susceptor may, for example, be made of or comprise conductive material, such as metal or carbon. The susceptor may be a susceptor band.

As indicated, according to different aspects, the invention provides a device for producing an aerosol-generating rod, a method for producing an aerosol-generating rod, and an aerosol-generating rod. The device may be suitable, adapted or configured to carry out the method. The device or the method may be suitable, adapted or configured to produce the aerosol-generating rod. Features described with respect to one of the aspects may be transferred to or combined with anyone of the other aspects.

The term 'aerosol-generating' is herein understood to describe that an item or a substance is capable of releasing volatile compounds into an air stream, preferably when the item or the substance is heated.

The term "funnel-shaped" with respect to the converging device means that an area of the cross-section of a forming space of the converging device, in a sectional plane perpendicular to the axial direction, decreases along the conveying direction. The decrease may be continuous or step-wise, or continuous and step-wise.

The forming space of the converging device may be, but does not have to be, fully enclosed circumferentially around the conveying direction by a wall of the converging device.

The term "herbaceous material" is used to denote material from an herbaceous plant. An "herbaceous plant" is an aromatic plant, where the leaves or other parts of the plant are used for medicinal, culinary or aromatic purposes and are capable of releasing flavor into the aerosol produced by an aerosol-generating article.

The diameter of the rod at a specific position along the axial direction refers to the largest extension of the rod at the specific position in any direction that is perpendicular to the axial direction.

The invention is defined in the claims. However, below there is provided a non-exhaustive list of non-limiting examples. Any one or more of the features of these examples may be combined with any one or more features of another example, embodiment, or aspect described herein.

Example Ex1: Device for producing an aerosol-generating rod, comprising:

- a converging device with a forming space converging along an axial direction;
- a susceptor guide extending into the forming space of the converging device and comprising an exit opening for a susceptor within the forming space of the converging device;
- a conveyor system configured to convey filling material, preferably formed as a sheet, through the forming space of the converging device to shape the filling material into a rod incorporating the susceptor; and
- at least one additive supply line having a dispensing opening that opens into the forming space of the converging device radially outward of the susceptor guide.

Example Ex2: Device according to Example Ex1, wherein the at least one additive supply line protrudes into the forming space of the converging device by no more than 20 millimeters, or no more than 10 millimeters, or no more than 5 millimeters, or no more than 3 millimeters, or no more than 2 millimeters, or no more than 1 millimeter.

Example Ex3: Device according to Example Ex1 or Ex2, wherein the at least one additive supply line is inclined at the dispensing opening into the axial direction, as compared to a direction perpendicular to the axial direction.

Example Ex4: Device according to any one of Examples Ex1 to Ex3, wherein the dispensing openings of at least two of the additive supply lines are arranged at different circumferential positions around the axial direction.

Example Ex5: Device according to any one of Examples Ex1 to Ex4, wherein the dispensing openings of the additive supply lines are arranged symmetrically with respect to the axial direction as axis of symmetry.

Example Ex6: Device according to any one of Examples Ex1 to Ex5, wherein a first dispensing opening of a first additive supply line and a second dispensing opening of a second additive supply line are located on opposing sides with respect to the susceptor guide.

Example Ex7: Device according to any one of Examples Ex1 to Ex6, wherein a dispensing opening of an additive supply line is upstream of a dispensing opening of another additive supply line with respect to the axial direction.

Example Ex8: Device according to any one of Examples Ex1 to Ex7, further comprising a converging device heating assembly configured to actively heat a heating region of the forming space, the heating region being at least partially downstream of the dispensing opening of the at least one additive supply line with respect to the axial direction.

Example Ex9: Device according to any one of Examples Ex1 to Ex8, further comprising an additive supply line heating assembly configured to actively heat the at least one additive supply line.

Example Ex10: Device according to any one of Examples Ex1 to Ex9, further comprising a cooling assembly configured to actively cool the rod, in particular by actively cooling a cooling region of the forming space.

Example Ex11: Device according to any one of Examples Ex1 to Ex10, further comprising a first additive reservoir and a second additive reservoir, the first additive reservoir being connected to a first additive supply line and the second additive reservoir being connected to a second additive supply line.

Example Ex12: Method for producing an aerosol-generating rod, with the steps of:

- conveying a susceptor band through a forming space of a converging device along an axial direction;
- shaping filling material, preferably being in the form of a sheet, into a rod incorporating the susceptor band by conveying the filling material through the forming space of the converging device along the axial direction; and
- dispensing an additive onto the filling material through a first dispensing opening that opens into the forming space of the converging device,
- wherein at least a part of the filling material passes between the first dispensing opening and the susceptor band while being conveyed through the forming space of the converging device.

Example Ex13: Method according to Example Ex12, wherein the additive comprises a gel.

Example Ex14: Method according to Example Ex12 or Ex13, wherein the additive is dispensed through the first dispensing opening at a position along the axial direction at which the filling material undergoes compression towards the susceptor band.

Example Ex15: Method according to any one of Examples Ex12 to Ex14, further comprising actively heating a heating region of the forming space at least partially downstream of the first dispensing opening with respect to the axial direction.

Example Ex16: Method according to any one of Examples Ex12 to Ex15, further comprising actively heating a first additive supply line supplying the additive to the first dispensing opening.

Example Ex17: Method according to any one of Examples Ex12 to Ex16, further comprising actively cooling the rod, preferably at a position along the axial direction at which shaping of the rod is complete, in particular by cooling a cooling region of the forming space.

Example Ex18: Method according to any one of Examples Ex12 to Ex17, wherein conveying the filling material through the forming space of the converging device comprises simultaneously conveying two webs of filling material through the forming space, the two webs of filling material preferably entering the forming space on opposite sides of the susceptor band.

Example Ex19: Method according to any one of Examples Ex12 to Ex18, further comprising dispensing an additive through a second dispensing opening that opens into the forming space of the converging device.

Example Ex20: Method according to Example Ex19, wherein the first dispensing opening is located upstream of the second dispensing opening with respect to the axial direction.

Example Ex21: Method according to Example Ex19 or Ex20, wherein additive is dispensed through the first dispensing opening on a first side of the susceptor band and additive is dispensed through the second dispensing opening on a second side of the susceptor band.

Example Ex22: Method according to any one of Examples Ex19 to Ex21, wherein the additive dispensed through the first dispensing opening has a different composition than the additive dispensed through the second dispensing opening.

Example Ex23: Method according to any one of Examples Ex19 to Ex22, wherein additive is dispensed through the first dispensing opening with a first pressure, and additive is dispensed through the second dispensing opening with a second pressure different from the first pressure.

Example Ex24: Method according to any one of Examples Ex12 to Ex23, wherein the additive comprises one or more aerosol-generating substances.

Example Ex25: Method according to any one of Examples Ex12 to Ex24, wherein the additive comprises one or more of nicotine, a flavorant, glycerin, and propylene glycol.

Example Ex26: Method according to any one of Examples Ex12 to Ex25, wherein the filling material comprises one or more of herbaceous material, a fiber substrate, a cellulose substrate, a cotton substrate, and a foam.

Example Ex27: Aerosol-generating rod, comprising:

- a susceptor that is heatable by exposing the susceptor to an alternating magnetic field;
- a sleeve of filling material, the sleeve of filling material surrounding the susceptor to form a rod incorporating the susceptor; and
- an aerosol-generating gel provided within the sleeve of filling material, without direct contact between the aerosol-generating gel and the susceptor.

Example Ex28: Aerosol-generating rod according to Example Ex27, wherein the filling material is crimped sheet material.

Example Ex29: Aerosol-generating rod according to Example Ex27 or Ex28, wherein the filling material is a sheet substrate of reconstituted herbaceous material, a fiber substrate, a cellulose substrate, a cotton substrate, or a foam substrate.

Example Ex30: Aerosol-generating rod according to any one of Examples Ex27 to Ex29, wherein the filling material is sheet material.

Example Ex31: Device according to any one of Examples Ex1 to Ex11, further comprising a vibration device configured to actively induce vibrations of at least a part of the device, in particular to induce vibrations of at least one of the converging device, the susceptor guide, and the additive supply line.

Example Ex32: Method according to any one of Examples Ex12 to Ex26, further comprising actively inducing vibrations of at least a part of the device, in particular to induce vibrations of at least one of the converging device, the susceptor guide, and the additive supply line.

Example Ex33: Equipment for the manufacturing of rods generating an aerosol comprising nicotine, said equipment comprising the device of any of the examples Ex1 to Ex11.

Example Ex34: Method according to Example Ex13, wherein the gel comprises nicotine.

Examples and embodiments will now be further described with reference to the figures, in which.

Figure 1:
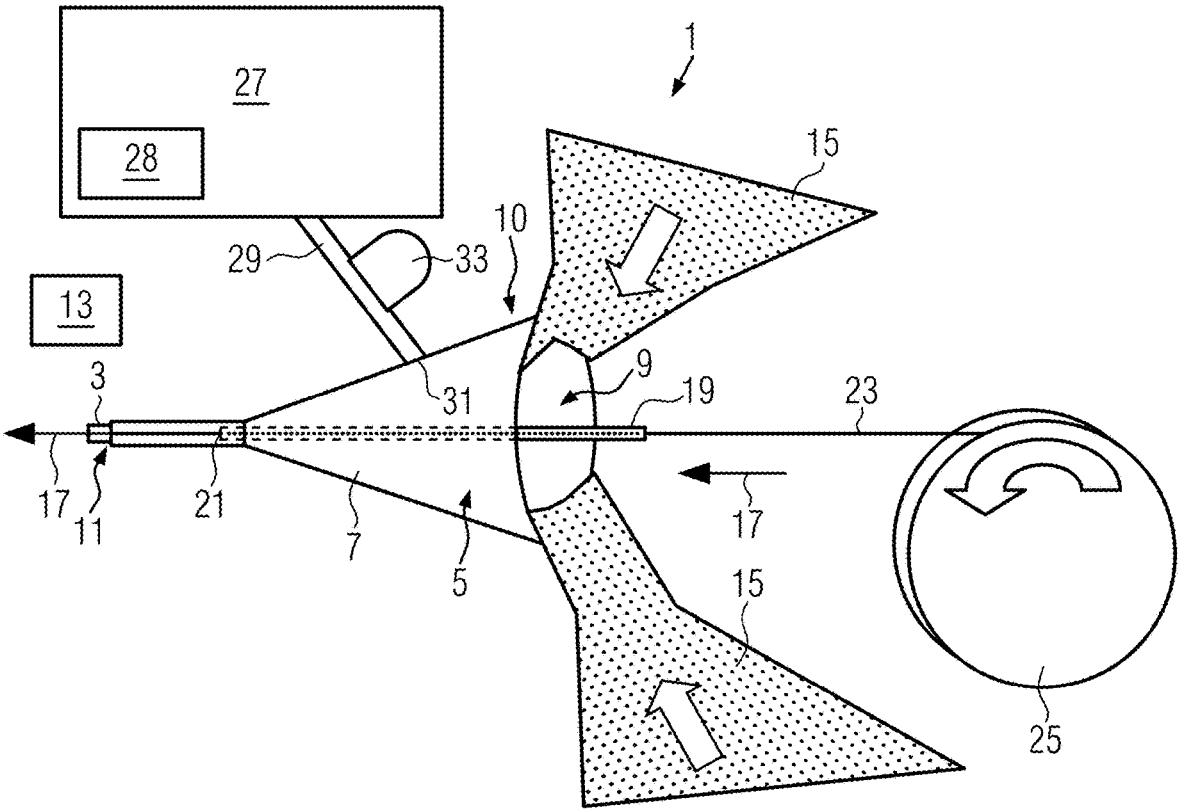
FIG. 1 shows a schematic side view of a device for producing an aerosol-generating rod according to an embodiment.

FIG. 1 shows a schematic side view of a device 1 for producing an aerosol-generating rod 3 according to embodiments. The device 1 comprises a converging device 5. The converging device 5 is funnel-shaped and has a wall 7 defining a forming space 9 therein to produce the aerosol-generating rod 3.

The converging device 5 comprises a first end 10 and a second end 11. A conveyor system 13 that is schematically shown in FIG. 1 conveys filling material 15 through the forming space 9 of the converging device 5 along an axial direction 17 from the first end 10 of the converging device 5 to the second end 11 of the converging device 5, for example by pulling.

A susceptor guide 19 extends into the forming space 9 of the converging device 5 along the axial direction 17 and comprises an exit opening 21 within the forming space 9. The conveyor system 13 is configured to convey a susceptor 23 through the forming space 9 of the converging device 5 along the axial direction 17. The susceptor 23 is guided by the susceptor guide 19 and exits the susceptor guide 19 within the forming space 9 through the exit opening 21.

The susceptor 23 is withdrawn from a supply row 25 as a susceptor band. The susceptor 23 is configured to be heated by being exposed to an alternating magnetic field. The susceptor 23 may be heated by means of induction heating. The susceptor 23 may, for example, be made of or comprise conductive material, such as metal or carbon.

A cross sectional area of the forming space 9, in a sectional plane in perpendicular to the axial direction 17, decreases along the axial direction 17. When the filling material 15 is conveyed through the converging device 5, the filling material 15 engages the wall 7 of the converging device 5 from inside the converging device 5 and is thereby shaped into the rod 3 incorporating the susceptor 23.

In the illustrated embodiment, the filling material 15 is conveyed through the forming space 9 of the converging device 5 as two sheets of material. The two sheets are conveyed through the forming space 9 along the axial direction 17 radially outside of the susceptor guide 19. The sheets, in the illustrated embodiment, enter the forming space 9 of the converging device 5 on opposing sides of the susceptor guide 19. Within the forming space 9, the sheets are shaped into a rod 3 incorporating the susceptor 23 by engaging the wall 7 of the converging device 5 and being compressed against the susceptor 23 from radially outside. Shaping the sheets into the rod 3 may comprise one or more of folding, bending, and compressing the sheets. Preferably, the sheets are crimped before entering the converging device 5 to facilitate folding, bending and compressing of the sheets.

As illustrated in FIG. 1, an additive reservoir 27 is connected to an inside of the converging device 5 by an additive supply line 29. The additive reservoir 27 stores an additive, in particular an aerosol-generating additive. Preferably, the additive is a gel or comprises a gel. In particular, the additive may be a thixotropic gel. The additive reservoir 27 may comprise viscosity adjustment means 28 to decrease the viscosity of the additive in the additive reservoir 27 to facilitate transporting the additive through the additive supply line 29. The viscosity adjustment means 28 may, for example, comprise one or more rotating blades or a heater.

The additive supply line 29 has a dispensing opening 31 opening into the forming space 9 of the converging device 5. While the susceptor 23 and the filling material 15 are conveyed through the forming space 9 of the converging device 5, additive is supplied into the forming space 9 through the additive supply line 29 by pumping the additive through the additive supply line 29 with a pump 33. The dispensing opening 31 of the additive supply line 29, opens into the forming space 9 radially outside of the susceptor guide 19. Upon being conveyed through the forming space 9, at least a part of the filling material 15 passes between the dispensing opening 31 of the additive supply line 29 and the susceptor 23.

In the illustrated embodiment, the dispensing opening 31 is essentially flush with the inner surface of the wall 7 of the converging device 5. The additive supply line 29 does not protrude into the forming space 9 of the converging device 5. In the alternative case that the additive supply line 29 radially protrudes into the forming space 9 of the converging device 5, the protrusion length of the additive supply line 29 into the forming space 9 preferably is small, such as no more than 20 millimeters or less, for example.

When the additive is dispensed through the dispensing opening 31 into the forming space 9 into the converging device 5, the additive is supplied to the filling material 15 from radially outside. The filling material 15 may act as a carrier for the additive. The additive may be taken along with the filling material 15 along the axial direction 17.

Figure 2:
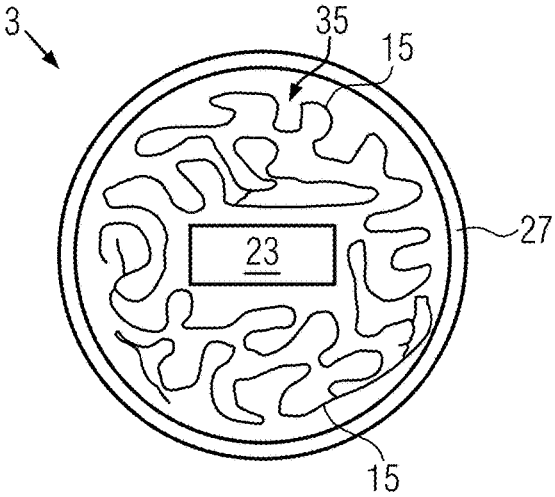
FIG. 2 shows a schematic sectional view of an aerosol-generating rod according to an embodiment.

FIG. 2 shows a schematic sectional view of the rod 3 after production. As shown, the susceptor 23 extends centrally within the rod 3 along the axial direction 17 (into the drawing plane in FIG. 2). The filling material 15, illustrated as folded and bent sheets in FIG. 2, forms a sleeve 35 circumferentially surrounding the susceptor 23. As illustrated, the filling material 15 forms bends and pockets in which the additive may reside.

Radially outside of the sleeve 35, the rod 3 comprises a wrapper 37 wrapped around the sleeve 35 after or while the rod 3 exits the converging device 5. The wrapper 37 may, for example, be formed of a paper sheet.

As the additive is dispensed onto the filling material 15 from radially outwards, the rod 3 may be manufactured without direct contact between the additive and the susceptor 23.

Figure 3:
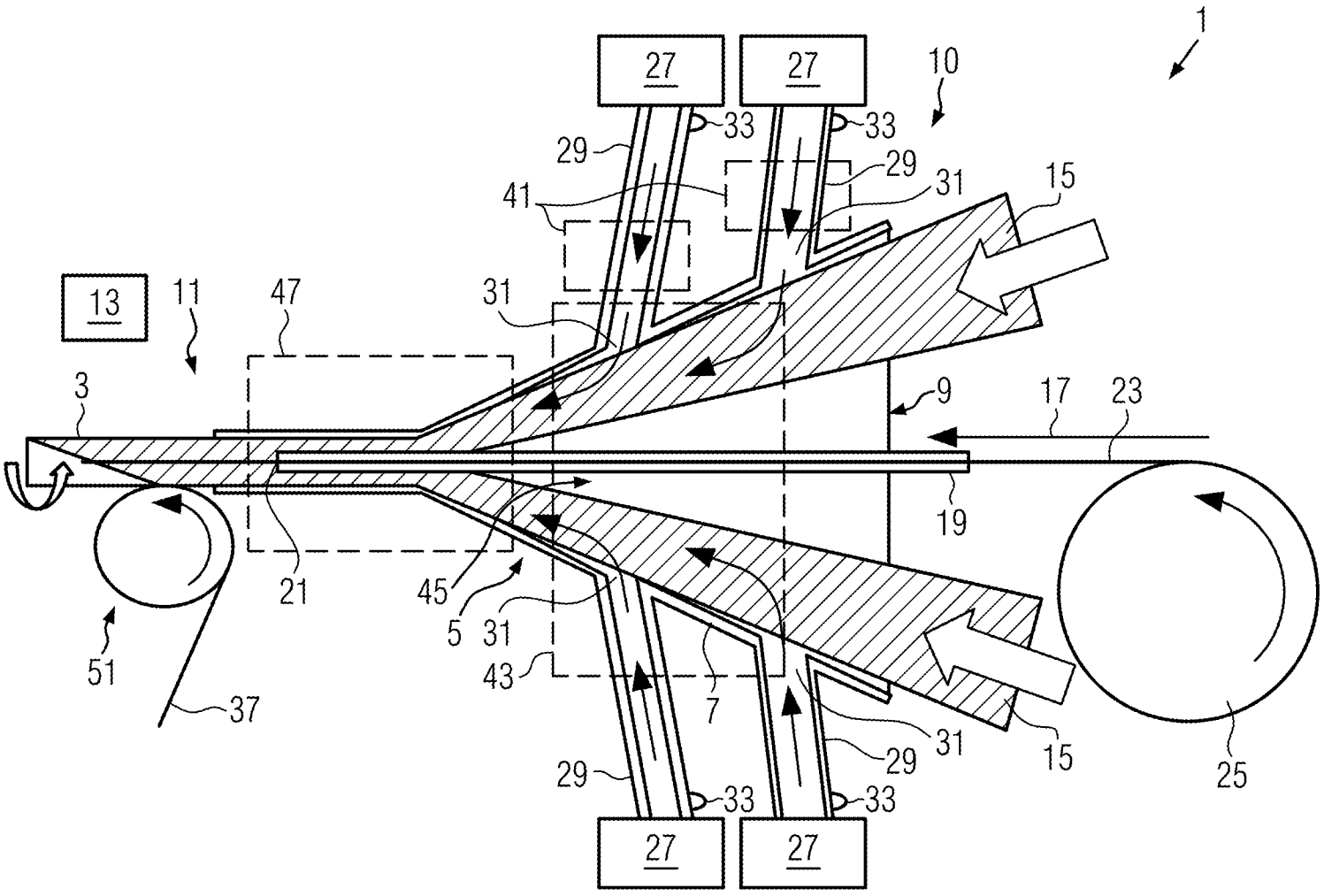
FIG. 3 shows a schematic sectional view of a device for producing an aerosol-generating rod according to an embodiment.

The device 1 schematically illustrated in FIG. 1 comprises only one additive reservoir 27 and one additive supply line 29. FIG. 3 schematically illustrates an alternative embodiment having more than one additive reservoir 27 and more than one additive supply line 29. In detail, the embodiment of FIG. 3 shows four additive reservoirs 27 and corresponding four additive supply lines 29. Aside from there being three additional additive reservoirs 27, corresponding additional additive supply lines 29, and pumps 33, the functional principle and general construction of the device 1 shown in FIG. 3 is similar to that of the device 1 shown in FIG. 1.

In FIG. 3, each of the additive supply lines 29 opens into the forming space 9 of the converging device 5 via a corresponding dispensing opening 31 through which the additive from the corresponding additive reservoir 27 is dispensed into the forming space 9. The dispensing openings 31 open into the forming space 9 radially outwards of the susceptor guide 19 and at least a part of the filling material 15 passes between the dispensing openings 31 and the susceptor 23, when being conveyed through the converging device 5.

In FIG. 3, there are two pairs of additive supply lines 29 and corresponding additive reservoirs 27. A first pair of additive supply lines 29 is shown above the susceptor guide 19 in FIG. 3 and the other pair of additive supply lines 29 is shown in FIG. 3 below the susceptor guide 19. The dispensing openings 31 of the first pair of supply lines 29 and the dispensing openings 31 of the second pair of supply lines 29 are provided on opposite sides of the susceptor 23 and the susceptor guide 19. The dispensing openings 31 of the additive supply lines 29 illustrated in FIG. 3 are arranged symmetrically with respect to the axial direction 17 as axis of symmetry. The dispensing openings 31 of the additive supply lines 29 of the same pair of supply lines 29 are arranged one behind the other along the axial direction 17.

Having multiple additive supply lines 29 with corresponding dispensing opening 31 allows dispensing additive into the forming space 9 at different locations to achieve a desired distribution of additive on the filling material 15. Having multiple additive reservoirs 27 with corresponding additive supply lines 29 allows dispensing different kinds of additive through the different dispensing openings 31. For example, all four additive reservoirs in FIG. 3 might hold different kinds of additives, or only two or three of the additive reservoirs might hold different kinds of additives. Alternatively, all four additive reservoirs 27 might hold the same kind of additive.

According to the embodiment shown in FIG. 3, the first pair of additive supply lines 29 (upper pair in FIG. 3), is provided with an additive supply line heating assembly 41 configured to actively heat the additive supply lines 29 to reduce the viscosity of the additive supplied by the additive supply lines 29. Further, according to the embodiment shown in FIG. 3, a converging device heating assembly 43 is provided to actively heat a heating region 45 of the forming space 9. The heating region 45 is at least partially downstream of at least one dispensing opening 29 with respect to the axial direction 17. By heating the heating region 45 in the forming space 9, the viscosity of the additive may be kept low even after the additive has left the additive supply line 29. This may facilitate distribution of the additive over the filling material 15.

In the embodiment illustrated in FIG. 3, a cooling assembly 47 is provided to actively cool the rod 3 downstream of the heating region 45. The cooling assembly 47 may cool the rod 3 to increase viscosity of the additive and to essentially fix the distribution of additive within the sleeve 35.

FIG. 3 also illustrates a wrapping assembly 51 downstream of the second end 11 of the converging device 5. The wrapping assembly 51 is configured to wrap the rod 3 with a wrapper 37, such as the paper wrapper 37 illustrated in FIG. 2.

Although the additive supply line heating assembly 41, the converging device heating assembly 43, and the cooling assembly 47 are only illustrated in FIG. 3, any one or more of those features may analogously be included into the device 1 of FIG. 1.

The invention claimed is:

1. Device for producing an aerosol-generating rod, comprising:

a converging device with a forming space converging along an axial direction;

a susceptor guide extending into the forming space of the converging device and comprising an exit opening for a susceptor within the forming space of the converging device;

a conveyor system configured to convey filling material through the forming space of the converging device to shape the filling material into a rod incorporating the susceptor;

at least one additive supply line having a dispensing opening that opens into the forming space of the converging device radially outward of the susceptor guide; and a first additive reservoir and a second additive reservoir, the first additive reservoir being connected to a first additive supply line of the at least one additive supply line and the second additive reservoir being connected to a second additive supply line of the at least one additive supply line.

2. Device according to claim 1, wherein the at least one additive supply line protrudes into the forming space of the converging device by no more than 20 millimeters, or no more than 10 millimeters, or no more than 5 millimeters, or no more than 3 millimeters, or no more than 2 millimeters, or no more than 1 millimeter.

3. Device according to claim 1, wherein the at least one additive supply line is inclined at the dispensing opening into the axial direction, as compared to a direction perpendicular to the axial direction.

4. Device according to claim 1, wherein the dispensing openings of at least two of the additive supply lines are arranged at different circumferential positions around the axial direction.

5. Device according to claim 1, wherein a first dispensing opening of an additive supply line of the at least one additive supply line and a second dispensing opening of another additive supply line of the at least one additive supply line are located on opposing sides with respect to the susceptor guide.

6. Device according to claim 1, wherein a dispensing opening of an additive supply line of the at least one additive supply line is upstream of a dispensing opening of another additive supply line of the at least one additive supply line with respect to the axial direction.

* * * * *